US005188054A

United States Patent [19]

Jacobs, Jr.

[11] Patent Number: 5,188,054

[45] Date of Patent: Feb. 23, 1993

[54] WATERCRAFT TOWING APPARATUS

[76] Inventor: John F. Jacobs, Jr., 16169 Anstell Ct., Mt. Clemens, Mich. 48044

[21] Appl. No.: 797,394

[22] Filed: Nov. 25, 1991

[51] Int. Cl.[5] ..... B63B 21/56

[52] U.S. Cl. ..... 114/250; 114/230

[58] Field of Search ..... 114/242, 249, 250, 230; 280/493, 494, 511, 513

[56] References Cited

U.S. PATENT DOCUMENTS

| | | | |
|---|---|---|---|
| 3,257,985 | 6/1966 | Glosten | 114/235 |
| 3,353,512 | 11/1967 | Mathews et al. | 114/235 |
| 3,568,621 | 3/1971 | Kawasaki | 114/250 |
| 4,453,487 | 6/1984 | Vinnari | 114/249 |
| 4,947,779 | 8/1990 | Grinde | 114/250 |

FOREIGN PATENT DOCUMENTS

| | | | |
|---|---|---|---|
| 718118 | 1/1932 | France | 280/511 |

*Primary Examiner*—Sherman Basinger

*Attorney, Agent, or Firm*—Basile and Hanlon

[57] ABSTRACT

An apparatus for towing a multi-hull watercraft includes a pair of spaced, rigid, tubular members extending between the rear of a towing craft to a location between the two hulls of the towed watercraft. Swivel connectors having mating members mounted on the towed watercraft and the multi-hull watercraft and on the ends of the first and second tubular members connect the two craft together at a fixed longitudinal distance; but allow vertical, independent movement of the two watercraft relative to each other. A plurality of flexible cables are movably coupled between diagonally opposed ends of the tubular members and a centrally located ring connector to enable each of the watercraft to roll about their respective yaw axis independent of each other and to maintain the spacing between the tubular members constant along their length from the first ends to the second ends.

31 Claims, 4 Drawing Sheets

WATERCRAFT TOWING APPARATUS

FIELD OF THE INVENTION

This invention relates generally to apparatus for towing watercraft and, most particularly, to apparatus for towing a multi-hull craft, such as a catamaran.

DISCUSSION OF THE PRIOR ART

Traditionally, larger watercraft are equipped with a smaller, lighter, and shallower auxiliary craft or tender particularly to accommodate making land falls when a traditional docking arrangement is unavailable or impractical due to the draft of the larger craft. Furthermore, in the pleasure boating field, it is commonly desired to accompany a larger pleasure craft suitable for significant open water passages with smaller recreational watercraft. Unfortunately, suitable deck space is typically at a premium on such pleasure craft and the onboard transportation of smaller recreational watercraft is further complicated by the difficulties associated with launching and retrieving the smaller craft. As a result, the towing of the smaller recreational craft has become relatively common, however, such towing presents its own particular problems and shortcomings.

In the traditional manner, a standard flexible rope or cable is used to interconnect the two craft by attachment to suitably strong attaching points. The selection of a correct length of towing ropes or cables is oft times difficult and largely dependent on the immediate condition surrounding the craft. For example, due to the difficulties in accurately maneuvering the towed craft, the towing line connecting the towing craft to the towed craft is typically maintained at a fairly short length in crowded harbors and anchorages which are typically sheltered and thus not subject to substantial wave action. However, maintaining the towed craft on a short tow line in open waters and at higher towing speeds is typically unacceptable since the towed craft has a tendency to be propelled into the towing craft in a following sea. A short tow line also tends to promote yawing, pitching, and similar undesired behavior on behalf of the towed craft principally as a result of the sharp angles and wake interaction associated with higher towing speeds and a short tow line. Conversely, a typical flexible towing line allows both the towing and the towed craft to interact largely independently to the wave and sea action encountered by each craft and typically confines the towing forces to intermittent linear tension applied to the towing connection of each craft.

As a result of the problems associated with conventional towing, several potential solutions based on the direct mechanical connection between the towed vessel and the towing vessel have previously been suggested.

For example, U.S. Pat. 3,353,512, to Matthews et al, presents a single mechanical connection between the two watercraft in conjunction with two safety lines independently extending between and connecting the two vessels in a relatively conventional fashion. This device, which appears to be directed more toward commercial watercraft, is too large and cumbersome for convenient use on pleasure craft, and also would appear to require very strong and substantial connecting apparatus in view of the substantial forces involved. Furthermore, the device in use is relatively complicated since, in addition to the mechanical connection between the two hulls, this device employs two safety lines in the form of a pair of relatively conventional tow lines arrayed on each side of the device which are designed to prevent the application of excessive yawing force to the single mechanical connection between the two vessels.

An alternative solution to the problem, once again principally directed to commercial watercraft, is presented in U.S. Pat. 3,257,985 to Glosten. Glosten is directed to commercial applications generally involving pushing, rather than the towing of other craft, although the Glosten apparatus would appear to be useful for towing as well. Glosten employs a hinge-like arrangement in order to prevent longitudinal misalignment between the two vessels and to allow the propelling vessel to accurately steer and direct the vessel being propelled. Glosten fails to accommodate the use of a interchangeable towing bars or booms with common connections on each end since it requires at least one hinged type connection to restrict the undesired horizontal misalignment of the tug and the tow.

U.S. Pat. 4,453,487 to Vinnari also discloses the use of booms or bars as the towing members. Although the Vinnari device would appear to facilitate certain independent movement between the two hulls in certain planes, it requires the use of at least three booms and a transverse bar if the towing device is to accommodate independent rolling of the two vessels. Furthermore, Vinnari also requires the use of independent steering cylinders when the device employs the transverse mounting bars to accommodate independent rolling. Obviously the use of hydraulic cylinders and complicated bulky towing equipment is generally unsuited for use with pleasure craft.

U.S. Pat. 4,947,779 to Grindy deals more specifically with the problems presented in the towing of a smaller recreational watercraft by a larger pleasure craft. Grindy relies on the flexibility of a single tow bar to accommodate pitch and roll between the towed and towing vessel. This requires a tow bar of longitudinal incompressibility with vertical flexibility. Furthermore, Grindy requires additional lines extending from the towed craft to the towing craft when significant lateral or transverse strain is anticipated.

Due to the disadvantages or problems encountered with the use of each of the above-described towing apparatus and the difficulties in applying such apparatus to pleasure craft, it is still desirable to provide an apparatus for towing a watercraft, such as a multi-hull watercraft or catamaran, which is simple and inexpensive in construction, easy to use, and which overcomes the above-mentioned problems associated with the prior art watercraft towing apparatus. It would also be desirable to provide a watercraft towing apparatus which maintains the towing and towed watercraft at a fixed longitudinal spacing regardless of the action or direction of movement of the towing watercraft. It would also be desirable to provide a watercraft towing apparatus which allows independent movement of the towing and towed watercraft relative to each other, including independent roll or yaw movement of each craft about its longitudinal center line.

SUMMARY OF THE INVENTION

The present invention is a watercraft towing apparatus for towing a watercraft by another towing watercraft.

The towing apparatus includes first and second spaced, rigid, tubular members. Separable swivable connector means, each including first and second separable and engageable connector members are associated with each end of the first and second tubular members and with the towing and towed watercraft. Each of the first connector members of the connector means are mounted on one end of the first and second tubular members. Each of the second connector members are mounted on the towed and towing watercraft. The connector means enables the first and second tubular members to be rigidly connected between the towing and towed watercraft so as to maintain the towing and towed watercraft at a fixed longitudinal spacing; while allowing substantial independent movement of each of the towing and towed watercraft about multiple axes of movement, independent of each other.

In a preferred embodiment, the connector means comprises a quick disconnect means in the form of a ball and socket swivel connector. Although the ball may be fixedly connected to either of the towing or towed watercraft or the ends of the first and second tubular members, preferably a pair of balls are fixedly mounted in a spaced arrangement to the rear end of the towing watercraft, such as to the transom or to a swim platform extending outward from the transom. Another pair of balls are mounted on the towed watercraft. The socket members of the connector means are preferably mounted at one end of a tubular housing which is rigidly connected to each of the ends of the first and second tubular members. A spring-biased clip means is mounted about the tubular housing and is movable from a first position encompassing the socket to retain the ball in the socket to a second position spaced from the socket to enable the ball to be inserted into the socket or removed therefrom.

Optionally, yaw control means may be provided on the towing apparatus of the present invention to enable yaw or roll action of each of the towing and towed watercraft about their respective longitudinal axis or center line, independent of each other, and to maintain the two tubular members in parallel and spaced apart the same distance as the distance between the first ends and the second end of the tubular members such that the axis of the towed craft remains substantially in-line with the axis of the towing craft despite any sideways forces exerted on the towed watercraft. The yaw control means includes a plurality of flexible members, each having first and second opposed ends. The first end of each flexible member is pivotally connected to one end of the first and second tubular members. Each of the flexible members extends diagonally from its first end toward the diagonally opposed end of the opposite one of the first and second tubular members. A central connector is located centrally laterally between the first and second tubular members and centrally longitudinally between the ends of the first and second tubular members. The second ends of each of the flexible members are rotatably connected to the central connector.

The towing apparatus of the present invention finds particular advantageous use when used to tow a multihull watercraft, such as a catamaran. In this application, a pair of ball connector members are mounted to the mast support beam of the catamaran adjacent the spaced hulls of the catamaran. The socket members mounted on the first and second tubular members ma be easily connected to the ball connectors to enable the catamaran to be towed.

The apparatus of the present invention may also be advantageously employed to attach or moor a watercraft to an object, such as a stationary dock, buoy, etc. In this application, a first pair of spaced ball connectors are mounted to the object, such as a dock. The sockets on the ends of the first and second tubular members may be attached to the ball connectors. The watercraft to be moored is then releasably connected to the opposite ends of the tubular members via the connectors mounted thereon. The apparatus operates in the same fashion as described above to maintain the watercraft moored to the object or dock at a fixed longitudinal distance from the object. Yet, the watercraft is free to exhibit vertical and sideways movement under wave or wind action as well as being able to roll about its yaw axis while remaining moored at the fixed longitudinal distance from the object or dock.

The watercraft towing apparatus of the present invention provides a simple and inexpensive means to releasably connect a watercraft to another watercraft for towing of the first watercraft The towing apparatus maintains a fixed longitudinal spacing between the two watercraft during towing operations while enabling the towing and towed watercraft to exhibit independent vertical movement, as well as rolling movement about their respective longitudinal yaw axes, relatively independent of each other. The control means connected between the diagonally opposed ends of the two tubular members also maintains the tubular members parallel to and constantly spaced the same distance apart despite any sideways forces exerted on the towed watercraft such that the towed watercraft remains substantially in-line with the towing craft.

The towing apparatus of the present invention is easily and separably attached to either the towing or towed watercraft. Further, the apparatus may be employed to attach or moor a watercraft to an object, such as a dock or buoy. In this application, the towing apparatus of the present invention maintains the moored watercraft at a fixed longitudinal distance from the object or dock; while enabling the watercraft to exhibit vertical, sideways and yaw movements under wave and wind action.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figure 1:
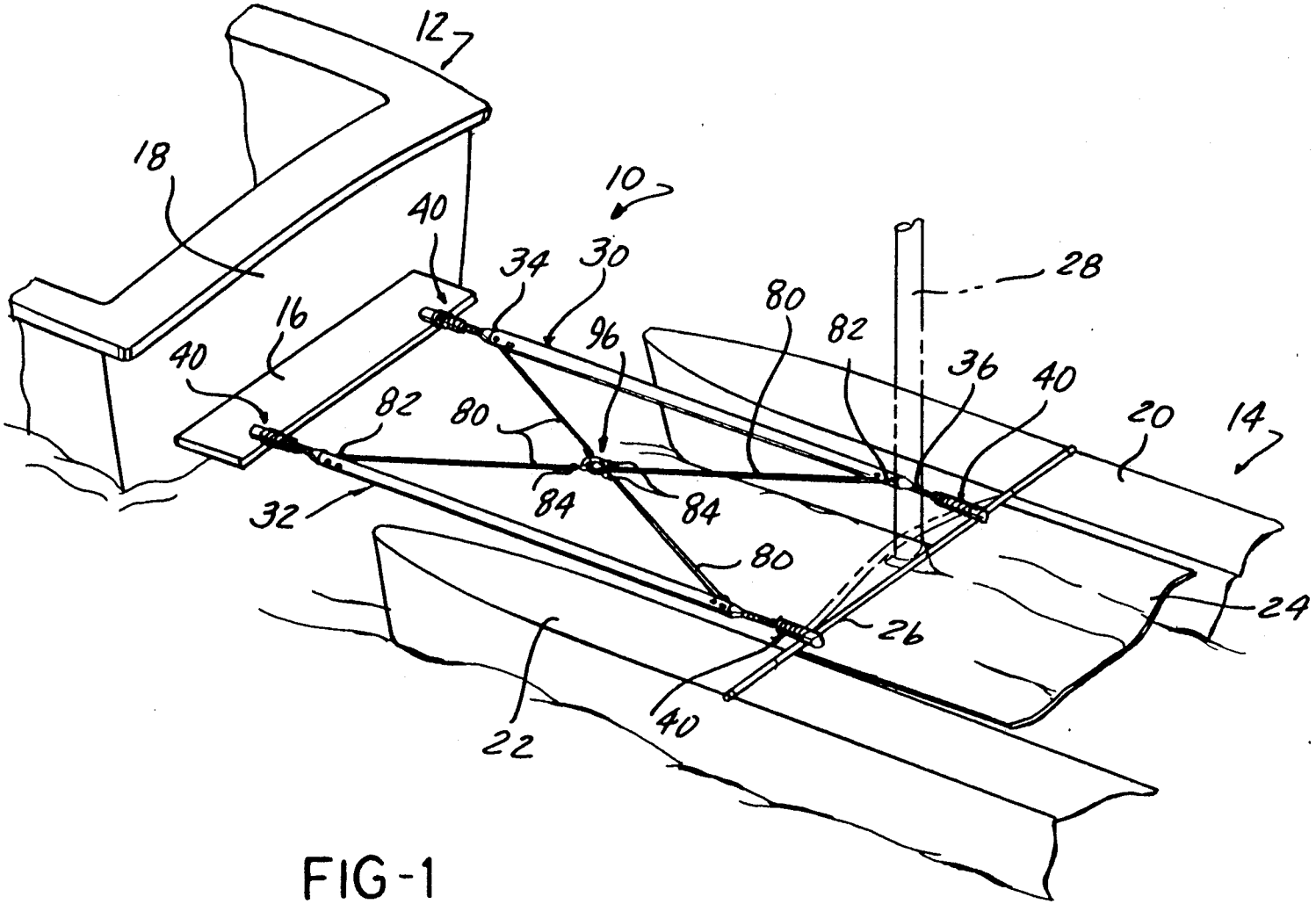
FIG. 1 is a perspective view showing the towing apparatus of the present invention mounted between two watercraft.

Referring now to the drawing, and to FIG. 1 in particular, there is illustrated a towing apparatus 10 which may be connected between a towing watercraft 12 and a towed watercraft 14 for towing of the towed watercraft 14.

The towing apparatus 10 of the present invention is useful with many different types of watercraft. The towing watercraft 12 may be any type of watercraft, such as motor or sail driven watercraft commonly referred to as "pleasure craft". Thus, although FIG. 1 depicts a portion of a motor driven power craft 12, it will be understood that the towing apparatus 10 of the present invention may also be used with other types of watercraft of marine vessels. As shown in FIG. 1, the towing watercraft 12 has an outwardly extending swim platform 16 mounted on and extending outward from the transom 18. The towing apparatus 10 of the present invention, as described hereafter, is attached to the swim platform 16. Other mounting arrangements in which the towing apparatus 10 is directly connected to the transom 18 are also described hereafter and encompassed within the scope of the present invention.

Likewise, the towed watercraft 14 may be any type of watercraft or marine vessel. For example, the towed craft 14 may comprise a small outboard, inflatable raft, etc. Other types of recreational watercraft, such as Jet Ski personal watercraft, may also be towed using the towing apparatus 10 of the present invention with only minor modifications made to the towing apparatus 10.

However, the towing apparatus 10 is particularly suited for towing multi-hull watercraft. In a preferred embodiment, such a towed watercraft 14 is a two-hulled craft commonly referred to as a catamaran. With minor modifications to the towing apparatus 10, a three-hulled or trimaran may also be towed when using the towing apparatus 10 of the present invention.

As is well know, a catamaran includes two spaced longitudinally extending, floatable hulls 20 and 22. A trampoline 24 is connected to and extends across the two hulls 20 and 22. A lower mast support beam 26 is likewise connected to and extends between the two hulls 20 and 22 at a forward end of the watercraft 14. The support beam 26 provides a lower support for a mast 28 as shown in FIG. 1.

Figure 2:
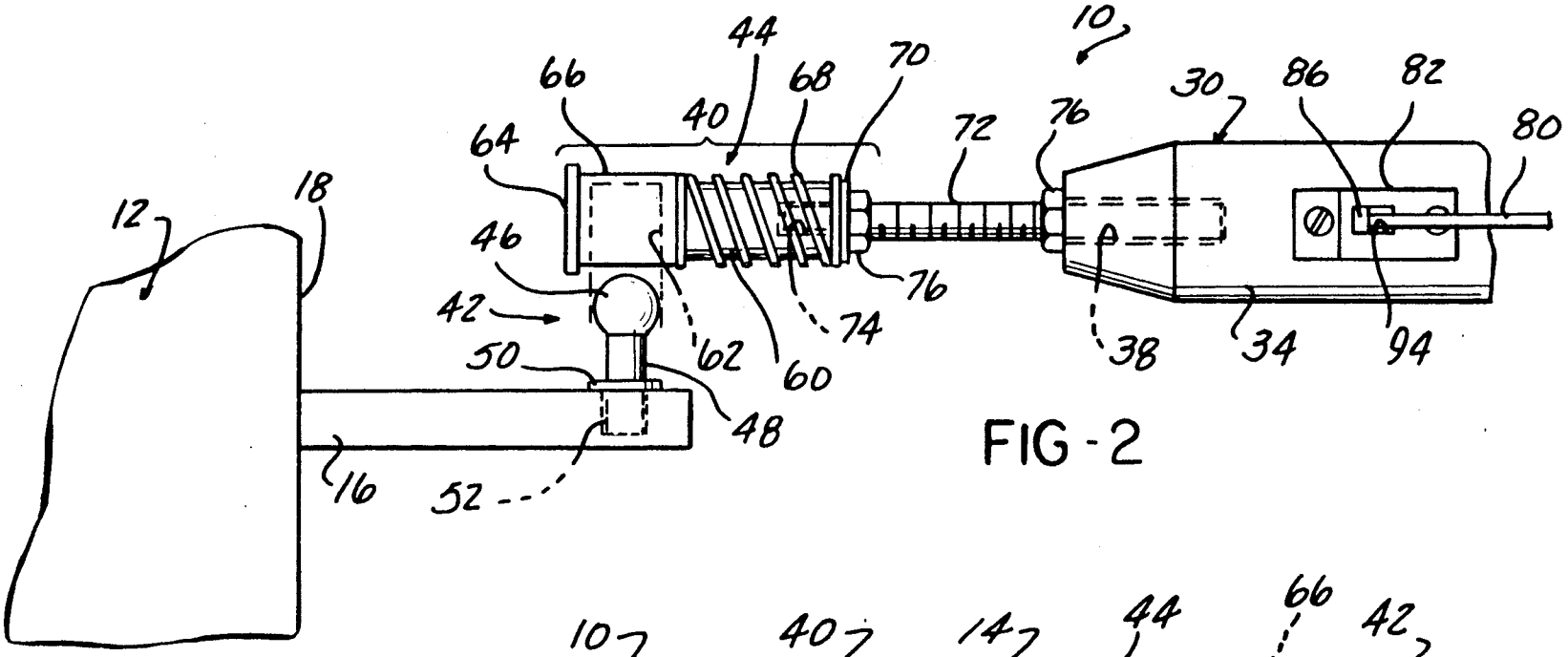
FIG. 2 is a side elevational view showing the connector means employed in the towing apparatus shown in FIG. 1.

The towing apparatus 10, as shown in FIGS. 1 and 2, includes first and second elongated, rigid tubular members 30 and 32. Each of the tubular members 30 and 32 has a generally cylindrical cross section and may be hollow or solid. The tubular members 30 and 32 are preferably formed of a strong, but lightweight material suitable for use in a marine environment, such as aluminum, stainless steel, high strength plastics, composites, etc.

As each of the first and second tubular members 30 and 32 is identically constructed, the following discussion will describe the general configuration of the first tubular member 30 and the other components of the tubular apparatus 10 associated therewith. It will be understood that similar components and construction applies to the second tubular member 32 and the other components of the towing apparatus 10 associated therewith.

The first tubular member 30 has first and second opposed ends 34 and 36, respectively. Threaded apertures or bores 38 are formed in each of the first and second ends 34 and 36 and extend inward along the longitudinal axis of the first tubular member 30. If the first tubular member 30 has a hollow construction, a threaded aperture is formed at the first and second ends 34 and 36. Alternately, if the first tubular member 30 is formed as a solid member, a threaded bore is formed in each of the first and second ends 34 and 36.

As shown in FIG. 1, the first and second tubular members 30 and 32 are spaced apart and are generally positioned in close proximity to the hulls 20 and 22 of the towed watercraft 14. The first and second tubular members 30 and 32 are parallel to each other and to the longitudinal axes of the towing watercraft 12 and the towed watercraft 14. The first ends 34 of each of the first and second tubular members 30 and 32 are positioned adjacent the rear of the towing watercraft 12, such as in proximity to the swim platform 16 as shown in FIGS. 1 and 2. The opposed second ends 36 of the first and second tubular members 30 and 32 are positioned in proximity with the mast support beam 26 of the towed watercraft 14.

Separable, swivable connector means 40, each including first and second separable connector members, are mounted on each of the first and second ends 34 and 36 of the first and second tubular members 30 and 32 and have one of the separable connector members mounted on a rear portion of the towing watercraft 12 and on a portion of the towed watercraft 14. As each of the connector means 40 in the present invention is identically constructed, only one connector means 40 will be described in detail hereafter.

As shown in detail in FIG. 2, each connector means 40 includes first and second separable connector members which are arranged as a quick-disconnect connector means. The first connector member 42 is preferably in the form of a ball having an enlarged, spherical head portion 46 and a narrower neck portion 48 extending therefrom. The neck portion 48 terminates in a mounting plate 50. A threaded shaft 52 extends from the mounting plate 50 and threadingly engages a threaded bore formed in the rear of the towing watercraft 12, such as in the swim platform 16.

Figure 3:
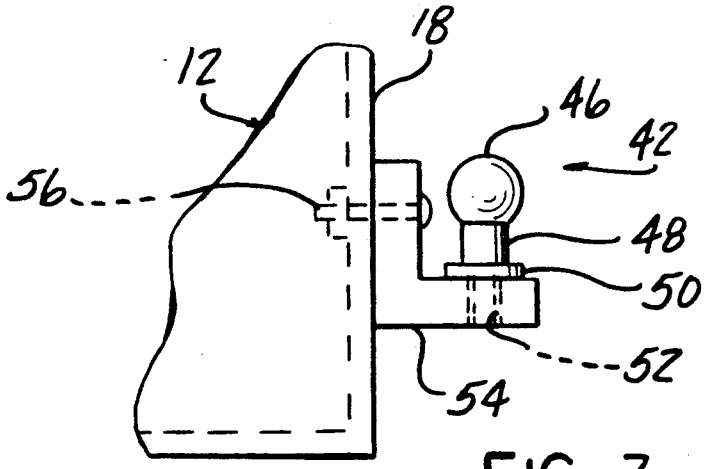
FIG. 3 is a partial, side elevational view showing another attachment method of the towing apparatus of the present invention to a towing craft.

Referring briefly to FIG. 3, there is shown an alternate means for mounting the first connector member 42 to the rear of the towing watercraft 12. In this embodiment, a generally L-shaped bracket 54 is secured to the transom 18 of the watercraft 12 by suitable fasteners 56. The first connector member 42 is threaded into one of the legs of the L-shaped bracket 54 so as to be mounted in a generally horizontal plane.

Figure 4:
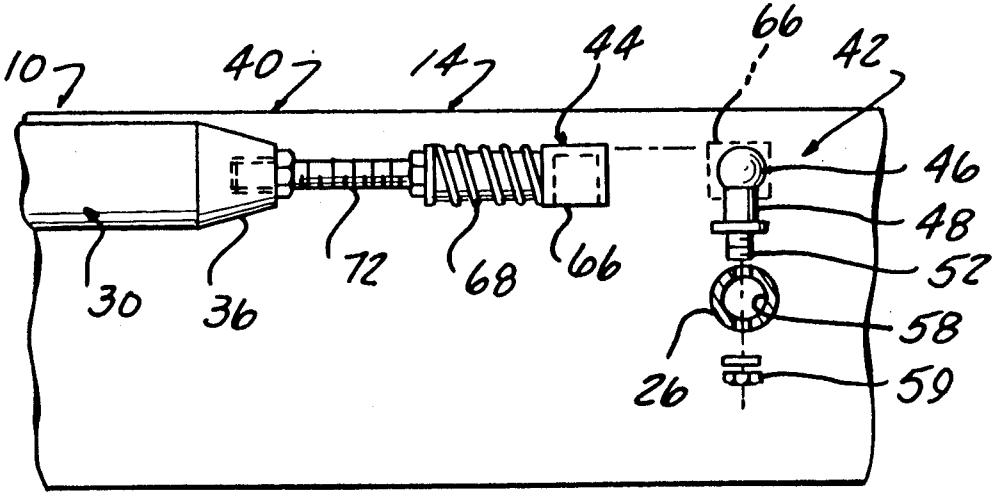
FIG. 4 is a partial, side elevational view showing a mode of attachment of the towing apparatus to a towed watercraft.

In FIG. 4, the connector means 40 associated with the towed watercraft 14 includes a similar first connector member 42 having an outwardly extending threaded shaft 52 which is adapted to engage a suitable mounting bracket disposed about the mast support beam 26 on the towed watercraft 14.

The second connector member 44 of each connector means 40, as shown in FIG. 2, is in the form of a generally cylindrical, tubular housing 60. An internal recess in the form of a spherical socket 62 is formed adjacent a first end 64 of the housing 60.

A spring-biased clip means is mounted concentrically about the housing 60 and operates to lock and unlock the enlarged head 46 of the ball 42 in the socket 62. The spring-biased clip means includes a cylindrical clip 66 which is movably disposed about the cylindrical housing 60. The clip 66 has a slot formed along one side wall, not shown, sized to slidingly engage the narrow neck portion 48 of the ball connector 42 to retain the enlarged head 46 of the ball 42 in the socket 62. A coil spring 68 is wound around the housing 60 and extends between a seat 70 at one end of the housing 60 and the clip 66. The spring 68 normally biases the clip 66 toward the first end 64 of the housing 60 over the socket 62. However, the clip 66 may be urged toward the opposite end of the housing 60 by a user applying sufficient force to overcome the biasing force of the spring 68 to thereby open the socket 62 in the housing 60 for the insertion or removal of the head 46 of the ball connector 42 to or from the socket 62, respectively. Release of the clip 66 enables the spring 68 to slide the clip 66 over the end of the housing 60 with the slot in the clip 66 surrounding the neck of the ball connector 42 to capture the enlarged head 46 of the ball connector 42 in the socket 62 of the housing 60. In this manner, the first and second tubular members 30 and 32 may be easily and quickly connected or disconnected to or from the towing watercraft 12.

Further, as shown in FIG. 2, the housing 60 is rigidly connected to the first end 34 of each of the first and second tubular members 30 and 32, only the first tubular member 30 is shown in FIG. 2, via a threaded rod 72 which extends between and engages the threaded aperture or bore 38 in the first end of each of the first and second tubular members 30 and 32 and a similar threaded bore 74 formed in one end of the housing 60. Lock nuts 76 are provided on the rod 76 to lock the housing 60 and the first and second tubular members 30 or 32 in a fixed rigid connection. Alternately, the housing 60 could be rigidly connected to the first or second tubular members 30 and 32 via other fastener means or by welding.

FIG. 4 shows the same ball and socket construction applied to the second end 36 of each of the first and second tubular members 30 and 32, with only the ball and socket associated with the second end 36 of the first tubular member 30 being shown in FIG. 4. All of the components shown in FIG. 2 are employed in the connector means 40 associated with the second ends 36 of each of the first and second tubular members 30 and 32.

The ball 46 is attached to the mast support beam 26 in any suitable manner. For example, as shown in FIG. 4, a pair of spaced apertures 58 are formed in the hollow mast support beam 26. The threaded shaft 52 on the ball 46 is inserted through one of the apertures 58 and is secured to the support beam 26 by a nut 59 which is inserted through the other aperture 58 and threaded onto the threaded rod 52. Other connection arrangements, such as an internal threaded bore in the rod 52 which receives a bolt therein, or the formation of the threaded rod 52 in an elongated length so as to extend through the support beam 26 and through a load bearing tube mounted inside the support beam 26 into engagement with a nut, may also be used to mount the ball 46 to the towed craft 14.

When the first and second tubular members 30 and 32 are connected via the connector means 40 to the towing watercraft 12 and the towed watercraft 14, as described above, the swivel connection provided by the connector means 40 enables each of the watercraft 12 and 14 to be movable in a generally horizontal plane or sideways with respect to each other as well as up and down in a generally vertical plane. However, while the watercraft 12 and 14 may exhibit such sideways and vertical displacement, relatively independent of each other, the rigid first and second tubular members 30 and 32 maintain a fixed longitudinal spacing or distance between the towing watercraft 12 and the towed watercraft 14. This overcomes the problems associated with previous watercraft towing apparatus in that the towed watercraft 14 is maintained at a fixed distance to the rear of the towing watercraft 12 regardless of the action or direction of movement of the towing watercraft 12. Thus, if the towing watercraft 12 slows or stops, the towing watercraft 14 is prevented from surging forward and striking the rear of the towing watercraft 12 due to the rigid first and second tubular members 30 and 32.

Further watercraft control may be provided by the towing apparatus 10 when optional yaw control means is mounted on the towing apparatus 10. The yaw control means is movably coupled between the first and second tubular members 30 and 32 and allows independent yaw or rolling movement of each of the towing and towed watercraft 12 and 14 about their respective longitudinal axes relatively independent of each other, and, further, maintains the first and second tubular members 30 and 32 longitudinally spaced apart at a fixed distance despite any sideway movement of the towed craft 14 with respect to the towing craft 12.

Figure 5:
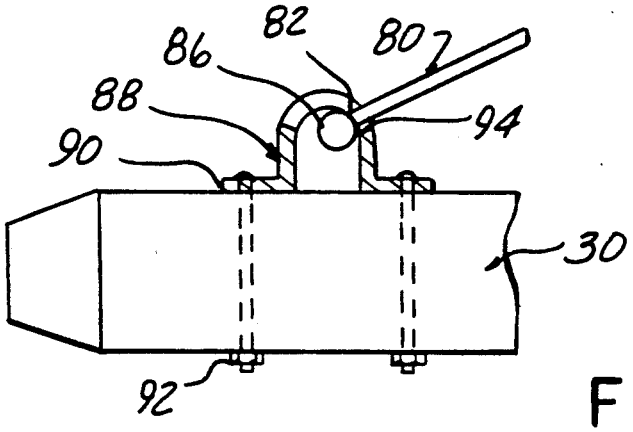
FIG. 5 is a partially cross sectioned plan view showing the attachment of one of the flexible cables of the yaw control means of the towing apparatus shown in FIG. 1.
Figure 6:
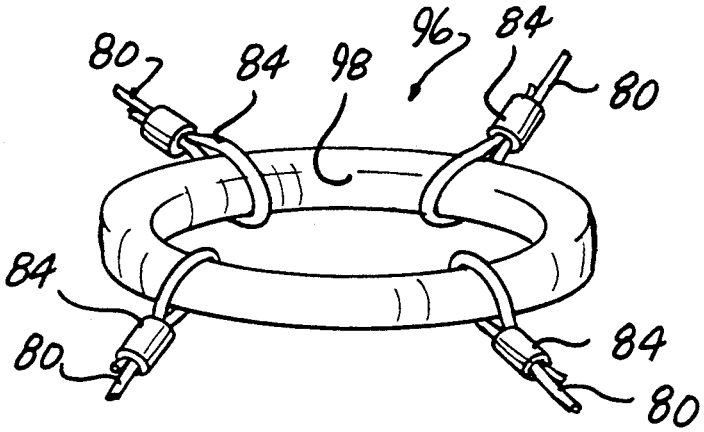
FIG. 6 is an enlarged, perspective view of a portion of the yaw control means shown in FIG. 1.

As shown in FIG. 1, and in greater detail in FIGS. 5 and 6, the yaw control means preferably comprises a plurality of flexible members 80, each having first and second opposed ends 82 and 84. Preferably, each of the flexible members 80 is formed of an elongated, relatively non-stretchable, rope or metal cable. The first ends 82 of each of the flexible members 80 are disposed adjacent to respective ones of the first and second ends 34 and 36 of the first and second tubular members 30 and 32. The flexible members 80 extend diagonally from the first ends 82 toward the opposed end of the opposite first and second tubular member 30 and 32.

As shown in FIGS. 1 and 5, an enlarged head or ball 86 is formed on the first end 82 of each of the flexible members 80. The ball 86 retains the first end 82 of the each of the flexible members 80 within a connector denoted generally by reference number 88. The connector 88 has a generally U-shape with two outwardly extending flanges 90. Fasteners 92, such as a bolt, extends through the flanges 90 and the associated end of one of the first and second tubular members 30 and 32 to secure the fastener 88 to the first and second tubular members 30 and 32. Further, the connector 88 has a centrally located slot 94 which is smaller in cross section or width than the diameter of the ball 86 on the first end 82 of each of the flexible members 80. In this manner, the first end 82 of each of the flexible members 80 is retained in the connector 88, but is free to pivot or move within the slot 94.

A central connector 96 is centrally located laterally between the first and second tubular members 30 and 32 and centrally between the opposed first and second ends 34 and 36 of the first and second tubular members 30 and 32. The central connector 96 is movably coupled to the second ends 84 of each of the flexible members 80.

As shown in FIG. 6, the central connector 96 is preferably in the form of a circular ring having an aperture extending therethrough. The second ends 84 of each of the flexible members 80 is movably coupled to the ring-like central connector 96 by any suitable means. By way of example only, as shown in FIG. 6, the second end 84 of each of the flexible members 80 are looped around the central connector 96 and secured back on themselves. Alternately, an eye may be provided at the second end 84 of each flexible member 80 for movable coupling the flexible member 80 to the central connector 96.

The yaw control means provided in the towing apparatus 10 enables each of the towing watercraft 12 and the towed watercraft 14 to roll about their respective yaw or longitudinal axis independent of each other. This prevents forces generated during such roll or yaw movements from being transmitted to the other watercraft which may impede the towing operation.

Further, the yaw control means maintains the first and second tubular members 30 and 32 as a fixed spacing equal to the spacing between the first ends 34 and the second ends 36 of the tubular members 30 and 32. Other control means, such as a rigid bar extending between the tubular members 30 and 32 intermediate the ends thereof may also be employed to maintain a fixed distance between the two tubular members 30 and 32 despite any sideways forces exerted on the towed watercraft 14. Accordingly, the towed watercraft 14 remains substantially co-axially in-line with the towing watercraft 12.

Figure 7A:
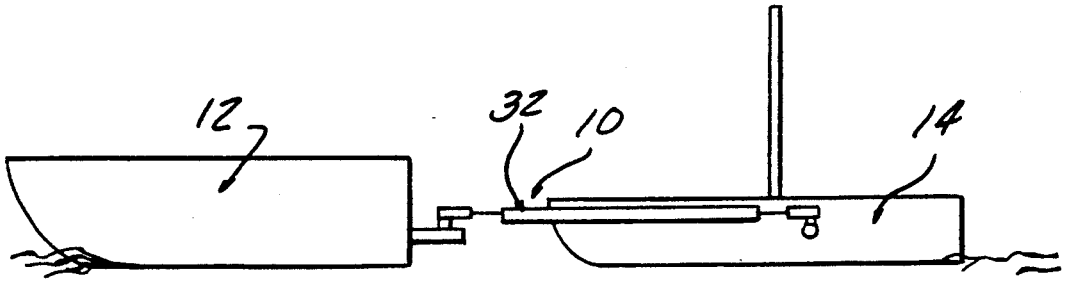
FIG. 7A, B and C are pictorial representations showing the various modes of movement of the towing and towed watercraft when using the towing apparatus of the present invention.

In use, as shown in FIG. 7A, the towing apparatus 10 is first connected to one of the watercraft, such as watercraft 12, via the connector means 40 adjacent the first ends 34 of the first and second tubular members 30 and 32. The towed watercraft 14 is then brought into proximity with the second ends 36 of the tubular members 30 and 32 and connected thereto via the connector means 40 on the second ends 36 of the tubular members 30 and 32. Alternately, of course, the towing apparatus 10 could be first connected to the towed watercraft 14 before the towing apparatus 10 is connected to the towing watercraft 12.

During such connection, the clip 66 on each of the connectors 40 is urged away from the socket 62 thereby opening the socket 62 for insertion of the ball 42 therein. The clip 66 is then released such that the spring 68 urges the clip 66 over the enlarged head 46 of the ball and retains the ball in a swivel connection within the socket 62.

Figure 7B:
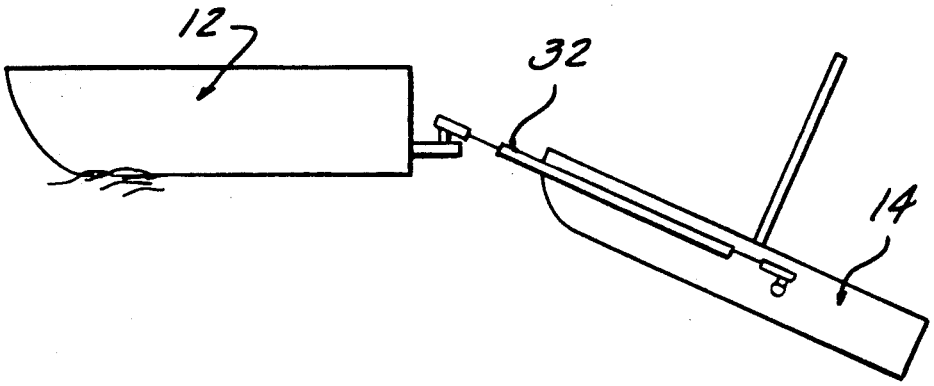

During towing, this swivel connection enables the towing and towed watercraft 12 and 14, respectively, to move vertically in an up or down direction, as shown in FIG. 7B, relatively independent of each other while maintaining the two watercraft 12 and 14 at a fixed longitudinal distance or spacing equal to the length of the tubular members 30 and 32.

Figure 7C:
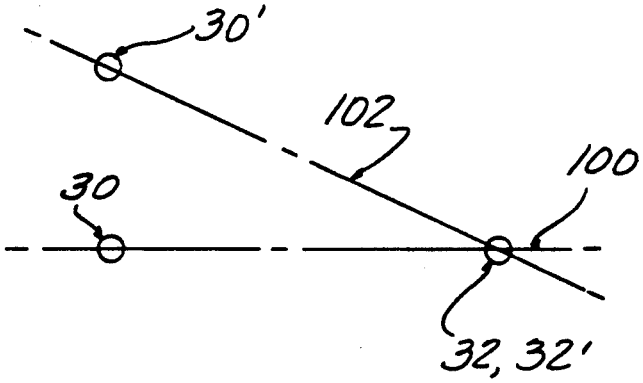

The function of the yaw control means described above is depicted in FIG. 7C in which either of the watercraft 12 or 14, such as the towed watercraft 14, may roll about its individual yaw or center line axis independent of the other craft. As shown in FIG. 7C, the first ends of the first and second tubular members 30 and 32 connected to the towing watercraft 12 are illustrated in a generally horizontal plane as denoted by reference number 100. The towed watercraft 14 is illustrated as rolling about its yaw or center line axis such that the plane through the second ends 36 of the tubular members 30 and 32 is angularly offset from the plane 100, as shown by reference number 102. However, during such yaw or rolling movements of either of the watercraft 12 or 14, any forces generated by such rolling movements are not transmitted to the other watercraft.

The towing apparatus 10 may also be employed to attach a watercraft, such as the watercraft 14, to an object, such as a stationary dock, movable buoy, etc. In this application, the connections at the second ends 36 of the tubular members 30 and 32 are identical and are attached to the watercraft 14 in the same manner as described above. The ball connectors 42 of the connector means 40 associated with the first ends 34 of the tubular members 30 and 32 are mounted to the object, such as a dock, buoy, etc. in the same spaced apart manner as shown in FIG. 1. This enables the connector means 40 on the first ends 34 of the tubular members 30 and 32 to be easily attached or disconnected from the associated ball connectors 42 on the object. When the watercraft 14 is attached by the apparatus 10 to such an object, the watercraft 14 is capable of exhibiting any of the vertical or yaw movements shown in FIG. 7B and 7C, as described above; while remaining at a fixed longitudinal spacing from the object.

In summary, there has been disclosed a unique towing apparatus which maintains a towed watercraft at a fixed longitudinal distance from a towing watercraft while enabling relatively independent vertical, sideways and yaw or roll movements of the two craft independent from each other. The towing apparatus of the present invention is simply and inexpensively constructed and is easily and quickly connectible between the towing and towed watercraft. The towing apparatus of the present invention also finds application in connecting or mooring a watercraft to an object, such as a dock.

What is claimed is:

1. An apparatus for towing a towed watercraft by a towing watercraft comprising:

first and second spaced, rigid, tubular members; and separable, swivable quick-disconnect connector means, each including first and second separable connector members, each first connector member mounted on each end of the first and second tubular members and each second connector member mounted on each of the towed and towing watercraft, for separable connection of the first and second tubular members to the towed and towing watercraft to maintain the towed and towing watercraft at a fixed longitudinal spacing while allowing substantially independent movement of each of the towed and towing watercraft along multiple axes of movement with respect to each other, the quick-disconnect connector means including:

a ball and socket swivel connector wherein the first connector member is a socket fixedly connected to each end of the first and second tubular members and the second connector member is a ball mounted on the towed and towing watercraft and swivably connectible to the socket, the ball and socket swivel connector further comprising:

a tubular housing having first and second ends;

the socket being formed in the first end of the tubular housing; and means for connecting the second end of the housing to the ends of the first and second tubular members; the means for connecting the second end of the housing comprises:

a first threaded bore formed in the second end of the tubular housing;

a threaded rod threadingly mounted in the bore and extending outward therefrom;

a second threaded bore formed in each end of the first and second tubular members;

the threaded rod threadingly engaging the threaded bore in the ends of the first and second tubular members to fixedly connect the housing to the ends of the first and second tubular members; and spring-biased clip means concentrically mounted about the housing of the socket for releasably securing the socket about the ball, the clip means being movable against the bias of a spring to a position opening the socket for insertion and removal of the ball therefrom.

2. The apparatus of claim 1 wherein:

a first pair of second connector members are mounted at spaced locations on the towing watercraft; and a second pair of second connector members are mounted on the towed watercraft.

3. An apparatus for towing a towed watercraft by a towing watercraft comprising:

first and second spaced, rigid, tubular members; and separable, swivable connector means, each including first and second separable connector members, each first connector member mounted on each end of the first and second tubular members and each second connector member mounted on each of the towed and towing watercraft, for separable connection of the first and second tubular members to the towed and towing watercraft to maintain the towed and towing watercraft at a fixed longitudinal spacing while allowing substantially independent movement of each of the towed and towing watercraft along multiple axes of movement with respect to each other; and yaw control means, coupled between the first and second tubular members, for allowing yaw movement of each of the towing and towed watercraft about their respective longitudinal axes independent of each other and for maintaining the spacing between the first and second tubular members constant along the entire length between the first and second ends of the first and second members.

4. The apparatus of claim 3 wherein the connector means comprises quick-disconnect connector means.

5. The apparatus of claim 4 wherein the quick-disconnect connector mean comprises:

a ball and socket swivel connector wherein the first connector member is a socket fixedly connected to each end of the first and second tubular members and the second connector member is a ball mounted on the towed and towing watercraft and swivably connectible to the socket.

6. The apparatus of claim 5 further comprising:

spring-biased clip means mounted about the socket for releasably securing the socket about the ball, the clip means being movable against the bias of a spring to a position opening the socket for insertion and removal of the ball therefrom.

7. The apparatus of claim 3 wherein the yaw control means comprises:

a plurality of flexible members, each having first and second opposed ends;

the first end of each flexible member being pivotally connected to a distinct end of one of the first and second tubular members;

each flexible member extending diagonally from the first end toward a diagonally opposed end of the opposite one of the first and second tubular members;

a central connector centrally located laterally between the first and second tubular members and longitudinally between opposed first and second ends of the tubular members; and the second ends of each of the flexible members being movably connected to the central connector.

8. The apparatus of claim 7 wherein the flexible members are flexible, substantially non-extendible cables.

9. The apparatus of claim 7 wherein the central connector comprises a ring having a central aperture extending therethrough.

10. The apparatus of claim 3 wherein:

the towed watercraft is a multi-hull watercraft having at least two spaced hulls.

11. The apparatus of claim 10 wherein the towed watercraft is a catamaran having two spaced hulls.

12. The apparatus of claim 10 wherein:

a first pair of second connector members are mounted on the multi-hull watercraft; and a second pair of second connector members are mounted on the towing watercraft.

13. An apparatus for towing a towed watercraft by a towing watercraft comprising:

first and second spaced, rigid, tubular members; and separable, swivable quick-disconnect connector means, the quick-disconnect connector means is a ball and socket swivel connector including first and second separable connector members wherein the first connector member is a socket fixedly connected to each end of the first and second tubular members and the second connector member is a ball mounted on each of the towed and towing watercraft and swivably connectible to the socket for separable connection of the first and second tubular members to the towed and towing watercraft to maintain the towed and towing watercraft at a fixed longitudinal spacing while allowing substantially independent movement of each of the towed and towing watercraft along multiple axes of movement with respect to each other; and yaw control means, coupled between the first and second tubular members, for allowing yaw movement of each of the towing and towed watercraft about their respective longitudinal axes independent of each other and for maintaining the spacing between the first and second tubular members constant along the entire length between the first and second ends of the first and second members.

14. The apparatus of claim 13 wherein the ball and socket swivel connector further comprises:

a tubular housing having first and second ends;

the socket being formed in the first end of the tubular housing; and means for connecting the second end of the housing to the ends of the first and second tubular members;

and clip means being concentrically mounted about the housing.

15. The apparatus of claim 13 further comprising:

spring-biased clip means mounted about the socket for releasably securing the socket about the ball, the clip means being movable against the bias of a spring to a position opening the socket for insertion and removal of the ball therefrom.

16. An apparatus for towing a towed watercraft by a towing watercraft comprising:

first and second spaced, rigid, tubular members;

separable, swivable, quick-disconnect connector means, each including first and second separable connector members, each first connector member mounted on each end of the first and second tubular members and each second connector member mounted on each of the towed and towing watercraft, for separable connection of the first and second tubular members to the towed and towing watercraft to maintain the towed and towing watercraft at a fixed longitudinal spacing while allowing substantially independent movement of each of the towed and towing watercraft along multiple axes of movement with respect to each other; and yaw control means, coupled between the first and second tubular members, for allowing yaw movement of each of the towing and towed watercraft about their respective longitudinal axes independent of each other and for maintaining the spacing between the first and second tubular members constant along the entire length between the first and second ends of the first and second members.

17. The apparatus of claim 16 wherein the second opposed ends;

the first end of each flexible cable being pivotally connected to a distinct end of one of the first and second tubular members;

each flexible cable extending diagonally from the first end toward a diagonally opposed end of the opposite one of the first and second tubular members;

a central connector centrally located laterally between the first and second tubular members and longitudinally between opposed first and second ends of the tubular members; and the second ends of each of the flexible cables being movably connected to the central connector.

18. An apparatus for towing a towed watercraft by a towing watercraft comprising:

first and second spaced, rigid, tubular members; and separable, swivable, quick-disconnect connector means, each including first and second separable connector members, each first connector member mounted on each end of the first and second tubular members and each second connector member mounted on one of the towed and towing watercraft, for separable connection of the first and second tubular members to the towed and towing watercraft to maintain the towed and towing watercraft at a fixed longitudinal spacing while allowing substantially independent movement of each of the towed and towing watercraft along multiple axes of movement with respect to each other;

the first connector member being a socket and the second connector member being a ball swivably connectible to the socket;

spring-biased clip means mounted about the socket for releasably securing the socket about the ball, the clip means being movable against the bias of a spring to a position opening the socket for insertion and removal of the ball therefrom;

the second connector member further comprising:

a tubular housing having first and second ends;

the socket being formed in the first end of the housing;

means for connecting the second end of the housing to the first and second ends of the tubular members; and the clip means being concentrically mounted about the housing;

a first pair of second connector members are mounted at spaced locations on the towing watercraft;

a second pair of second connector members are mounted on the towed watercraft;

yaw control means movably coupled between diagonally opposed ends of the first and second tubular members, for allowing yaw movement of each of the towing and towed watercraft about their respective longitudinal axes independent of each other;

the yaw control means comprising:

a plurality of flexible cables each having first and second opposed ends;

the first end of each flexible cables being pivotally connected to a distinct end of one of the first and second tubular members;

each flexible cable extending diagonally from the first end toward a diagonally opposed end of the opposite one of the first and second tubular members;

a central connector centrally located laterally between the first and second tubular members and longitudinally between opposed first and second ends of the tubular members; and the second ends of each of the flexible cables being movably connected to the central connector.

19. An apparatus for attaching a watercraft to an object comprising:

first and second spaced, rigid, tubular members;

separable, swivable, quick-disconnect connector means, each including first and second separable connector members, each first connector member mounted on each end of the first and second tubular members and each second connector member mounted on one of the object and the watercraft, for separable connection of the first and second tubular members to the object and the watercraft to maintain the object and the watercraft at a fixed longitudinal spacing while allowing substantially independent movement of the watercraft along multiple axes of movement with respect to the object, the quick-disconnect connector means including:

a ball and socket swivel connector wherein the first connector member is a socket fixedly connected to each end of the first and second tubular members and the second connector member is a ball mounted on the watercraft and the object and swivably connectible to the socket, the ball and socket swivel connector further comprising:

a tubular housing having first and second ends;

the socket being formed in the first end of the tubular housing; and means for connecting the second end of the housing to the ends of the first and second tubular members; the means for connecting the second end of the housing comprising:

a first threaded bore formed in the second end of the tubular housing;

a threaded rod threadingly mounted in the bore and extending outward therefrom;

a second threaded bore formed in each end of the first and second tubular members;

the threaded rod threadingly engaging the threaded bore in the ends of the first and second tubular members to fixedly connect the housing to the ends of the first and second tubular members; and spring-biased clip means concentrically mounted about the housing of the socket for releasably securing the socket about the ball, the clip means being movable against the bias of a spring to a position opening the socket for insertion and removal of the ball therefrom.

20. The apparatus of claim 19, wherein:

a first pair of second connector members are mounted at spaced locations on the object; and a second pair of second connector members are mounted on the watercraft.

21. An apparatus for attaching a watercraft to an object comprising:

first and second spaced, rigid, tubular members;

separable, swivable connector means, each including first and second separable connector members, each first connector member mounted on each end of the first and second tubular members and each second connector member mounted on one of the object and the watercraft, for separable connection of the first and second tubular members to the object and the watercraft to maintain the object and the watercraft at a fixed longitudinal spacing while allowing substantially independent movement of the watercraft along multiple axes of movement with respect to the object; and control means, coupled between the first and second tubular members, for maintaining the spacing between the first and second tubular members constant along the entire length between the first and second ends of the first and second members.

22. The apparatus of claim 21 wherein the connector means comprises quick-disconnect connector means.

23. The apparatus of claim 22 wherein the quick-disconnect connector means comprises:

a ball and socket swivel connector wherein the first connector member is a socket fixedly connected to each end of the first and second tubular members and the second connector member is a ball mounted on the watercraft and the object and swivably connectible to the socket.

24. The apparatus of claim 23 further comprising:

spring-biased clip means mounted about the socket for releasably securing the socket about the ball, the clip means being movable against the bias of a spring to a position opening the socket for insertion and removal of the ball therefrom.

25. The apparatus of claim 24 wherein the ball and socket swivel connector further comprises:

a tubular housing having first and second ends;

the socket being formed in the first end of the tubular housing; and means for connecting the second end of the housing to the ends of the first and second tubular members;

the clip means being concentrically mounted about the housing.

26. The apparatus of claim 21 wherein the control means comprises:

a plurality of flexible members, each having first and second opposed ends;

the first end of each flexible member being pivotally connected to a distinct end of one of the first and second tubular members;

each flexible member extending diagonally from the first end toward a diagonally opposed end of the opposite one of the first and second tubular members;

a central connector centrally located laterally between the first and second tubular members and longitudinally between opposed first and second ends of the tubular members; and the second ends of each of the flexible members being movably connected to the central connector.

27. The apparatus of claim 26 wherein the flexible members are flexible, substantially non-extendible cables.

28. The apparatus of claim 26 wherein the central connector comprises a ring having a central aperture extending therethrough.

29. The apparatus of claim 21 wherein:

the watercraft is a multi-hull watercraft having at least two spaced hulls.

30. The apparatus of claim 29 wherein the watercraft is a catamaran having two spaced hulls.

31. The apparatus of claim 29 wherein:

a first pair of second connector members are mounted on the watercraft; and a second pair of second connector members are mounted on the object.

* * * * *